US011745085B1

(12) United States Patent
Potts

(10) Patent No.: US 11,745,085 B1
(45) Date of Patent: Sep. 5, 2023

(54) DOWNHILL SNOW SKI SOUND SYSTEM

(71) Applicant: Jeffrey Potts, American Fork, UT (US)

(72) Inventor: Jeffrey Potts, American Fork, UT (US)

( * ) Notice: Subject to any disclaimer, the term of this patent is extended or adjusted under 35 U.S.C. 154(b) by 11 days.

(21) Appl. No.: 17/672,982

(22) Filed: Feb. 16, 2022

(51) Int. Cl.
*A63C 11/00* (2006.01)
*A63C 9/00* (2012.01)
*A63C 10/14* (2012.01)

(52) U.S. Cl.
CPC ..... *A63C 11/003* (2013.01); *A63C 9/003* (2013.01); *A63C 10/14* (2013.01)

(58) Field of Classification Search
CPC ..... A63C 10/14; A63C 10/145; A63C 10/28; A63C 5/07; A63C 10/06; A63C 11/00; A63C 5/06; A63C 9/002; A63C 11/003; A63C 9/003; A43B 5/0403; Y10T 29/49947
See application file for complete search history.

(56) References Cited

U.S. PATENT DOCUMENTS 4,438,482 A * 3/1984 Leon ..... A43B 1/0036 362/186
4,824,139 A * 4/1989 Robbins ..... A63C 17/26 455/344
10,864,429 B2 * 12/2020 Dreifus ..... A63C 10/005
2004/0100792 A1 * 5/2004 Trzecieski ..... A63C 3/00 36/137
2005/0160902 A1 * 7/2005 Iwai ..... A63C 17/012 84/723
2006/0008104 A1 * 1/2006 Sausser ..... H04R 5/02 381/124
2008/0150255 A1 * 6/2008 Hogenmiller ..... A63C 11/003 280/611
2012/0039483 A1 * 2/2012 Burke ..... H04R 5/023 381/86

FOREIGN PATENT DOCUMENTS

CA 2823445 A1 * 2/2014 ..... A63C 10/28

* cited by examiner

*Primary Examiner* — James A Shriver, II
*Assistant Examiner* — Michael T. Walsh

(57) ABSTRACT

A downhill snow ski sound system comprises a speaker coupled to a binding of a snowboard or ski. An orifice is located at a perimeter of the binding and a strap is coupled to and extends from the orifice. The speaker is releasably coupled to the binding by the strap. The speaker is positioned adjacent the binding with less than an inch between the speaker and the binding. The speaker is also positioned directly on and contacting the ski-board.

20 Claims, 7 Drawing Sheets

DOWNHILL SNOW SKI SOUND SYSTEM

BACKGROUND

Downhill skiing is a popular sport. Earbuds, earphones or headphones can be worn to listen to music while skiing. Some can be wireless and can receive a wireless radio signal from a remote music player or cellular phone. It can difficult to find earbuds if fall from the ear into the snow. Some can be wired and can have a wire that can become tangles while skiing. In addition, hearing a talking to ski companions can be difficult with earbuds or earphones in the ear. The development of solutions is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
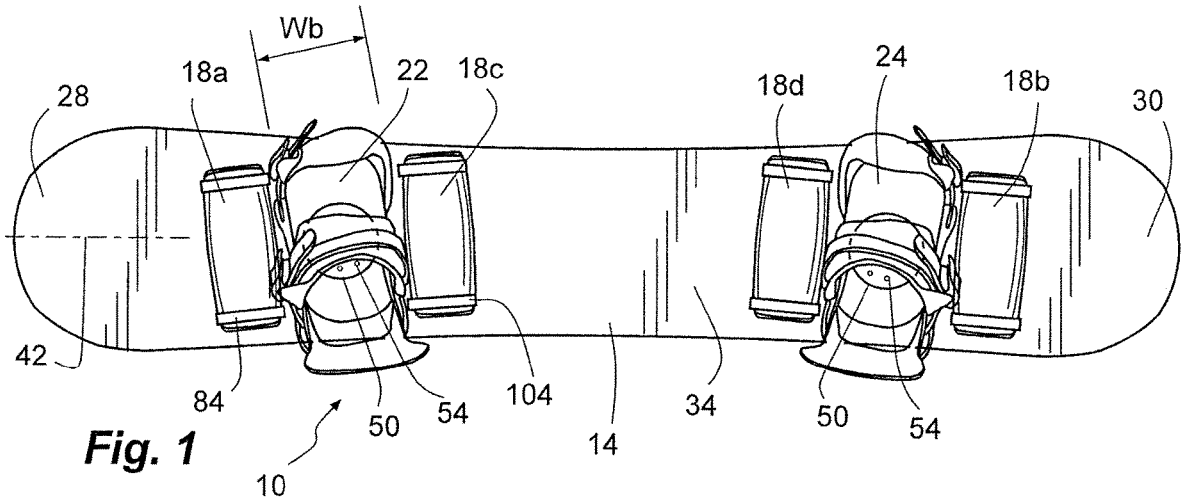
FIG. 1 is a top schematic view of a downhill snow ski sound system in accordance with an embodiment of the invention showing four wireless speakers carried by a snowboard.
Figure 2:
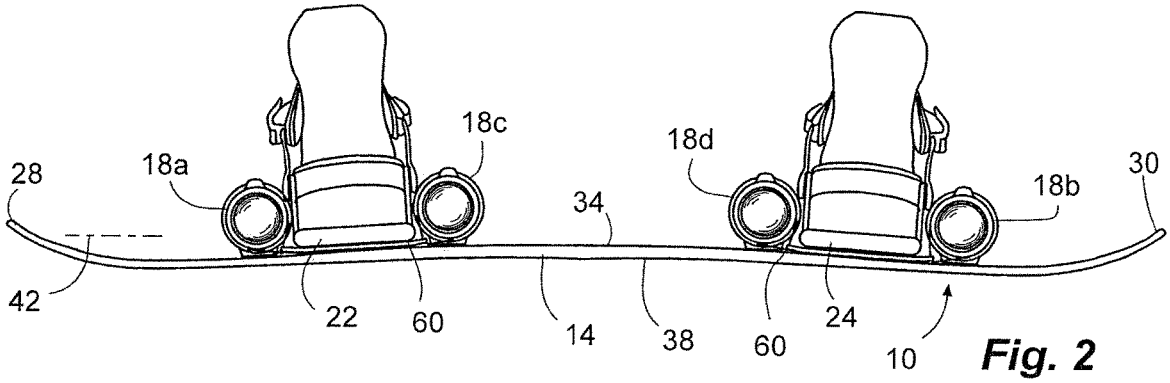
FIG. 2 is a side schematic view of the system of FIG. 1.
Figure 3:
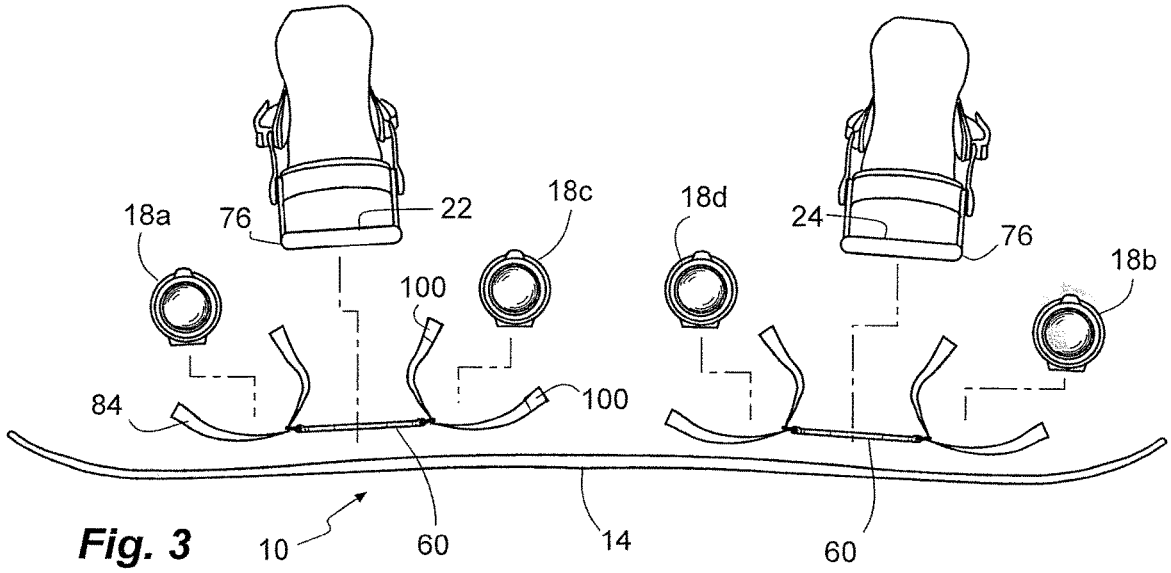
FIG. 3 is a side schematic exploded view of the system of FIG. 1.
Figure 4:
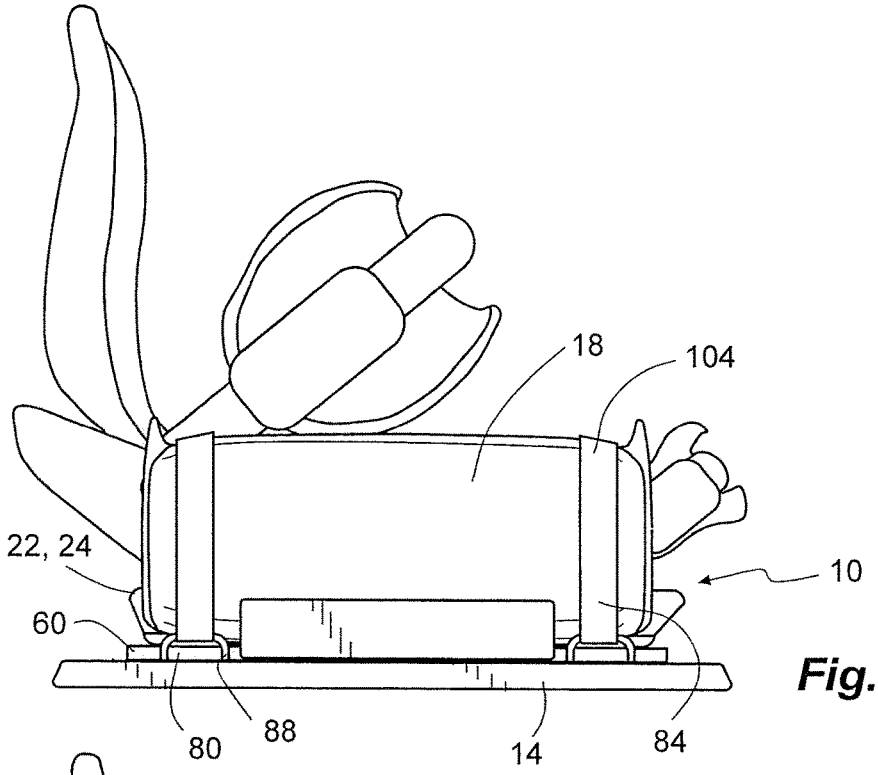
FIG. 4 is an end schematic view of the system of FIG. 1.
Figure 5:
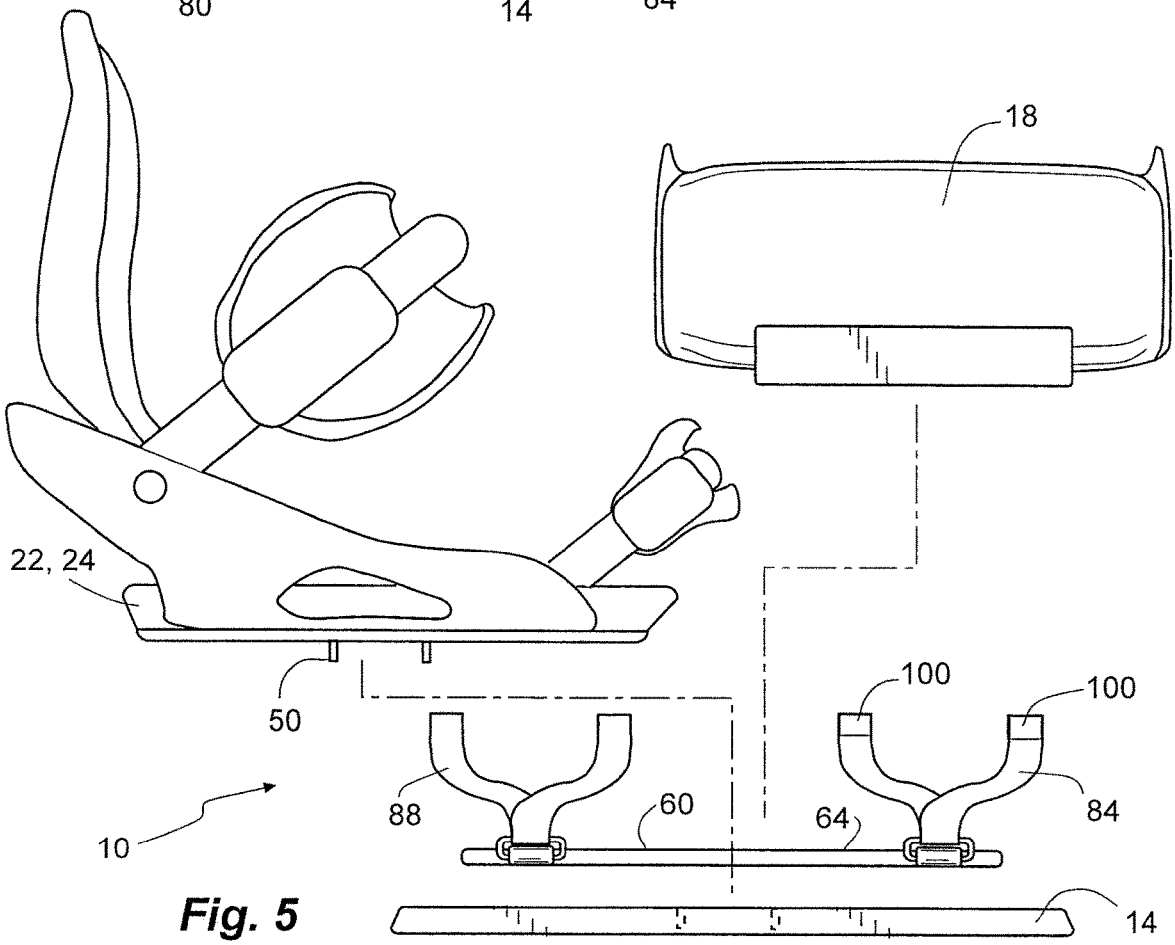
FIG. 5 is an end exploded view of the system of FIG. 1.
Figure 6:
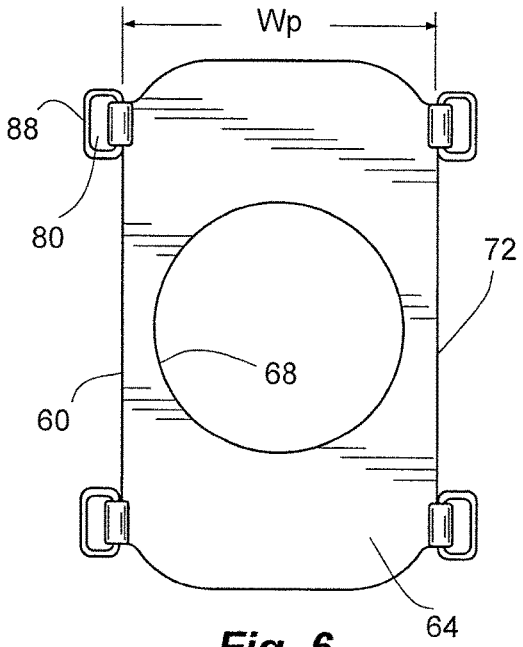
FIG. 6 is a top view of a plate of a mount of the system of FIG. 1.
Figure 7:
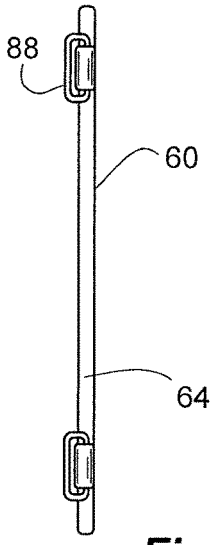
FIG. 7 is an end view of the plate of the mount of the system of FIG. 1.
Figure 8:
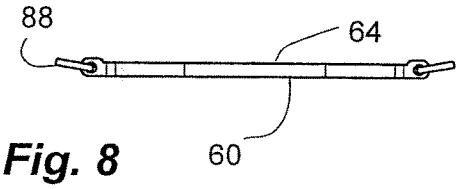
FIG. 8 is a side view of the plate of the mount of the system of FIG. 1.
Figure 10:
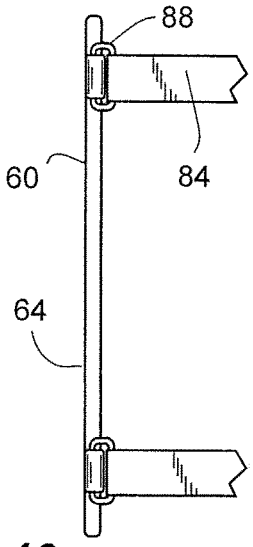
FIG. 10 is an end view of the strap with the plate of the mount of the system of FIG. 1.
Figure 9:
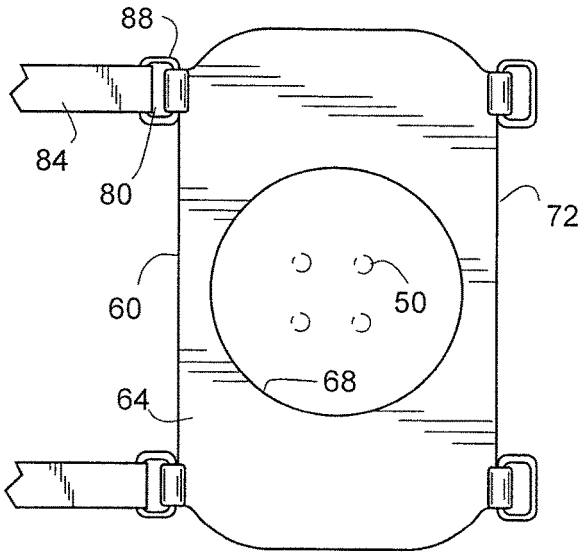
FIG. 9 is a top view of a strap with the plate of the mount of the system of FIG. 1 in accordance with an embodiment of the invention.
Figure 11:
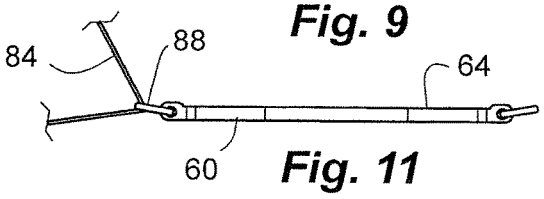
FIG. 11 is a side view of the strap with the plate of the mount of the system of FIG. 1.
Figure 12:
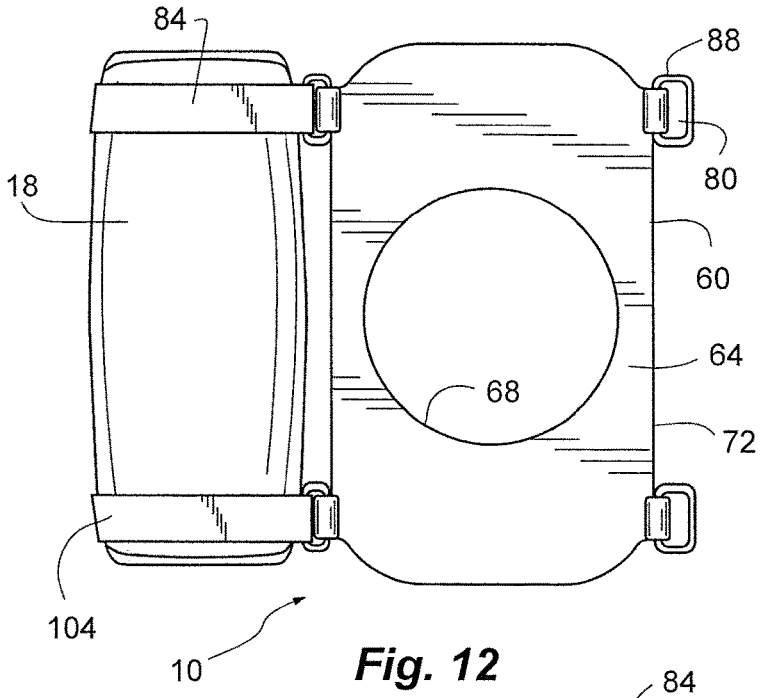
FIG. 12 is a top view of the mount of the system of FIG. 1 in accordance with an embodiment of the invention shown retaining the wireless speaker.
Figure 13:
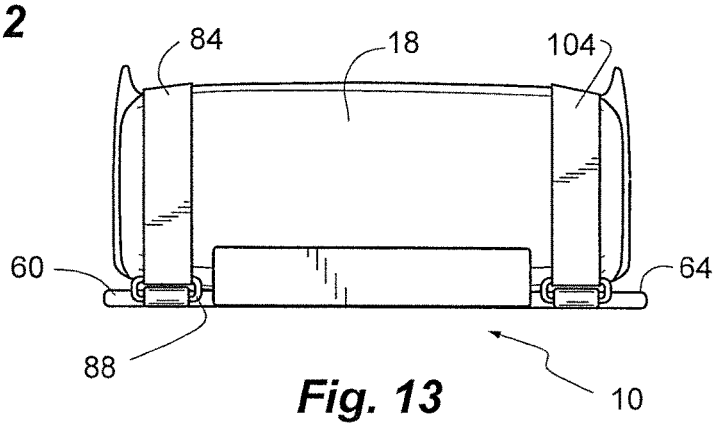
FIG. 13 is an end view of the mount of the system of FIG. 1 shown retaining the wireless speaker.
Figure 14:
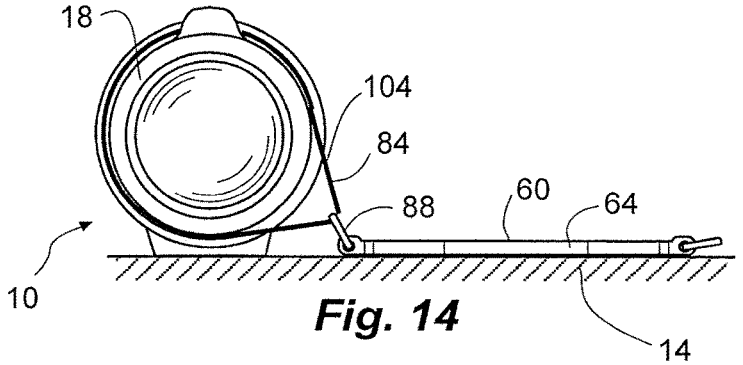
FIG. 14 is a side view of the mount of the system of FIG. 1 shown retaining the wireless speaker.
Figure 15:
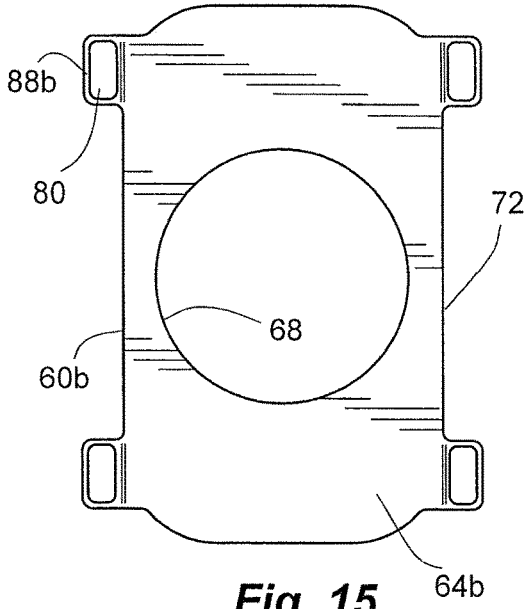
FIG. 15 is a top view of another plate of a mount of a system in accordance with an embodiment of the invention.
Figure 16:
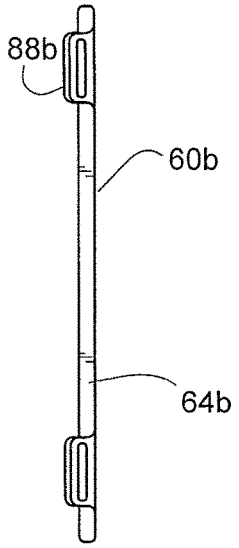
FIG. 16 is an end view of the plate of the mount of the system of FIG. 15.
Figure 17:
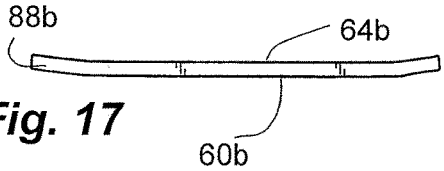
FIG. 17 is a side view of the plate of the mount of the system of FIG. 15.
Figure 19:
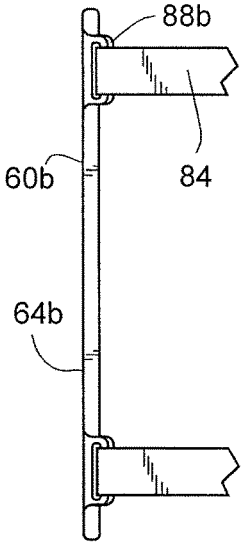
FIG. 19 is an end view of the strap with the plate of the mount of the system of FIG. 15.
Figure 18:
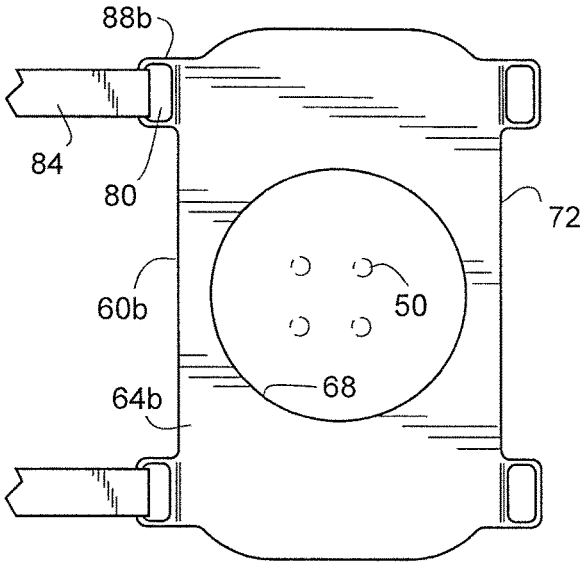
FIG. 18 is a top view of a strap with the plate of the mount of the system of FIG. 15 in accordance with an embodiment of the invention.
Figure 20:
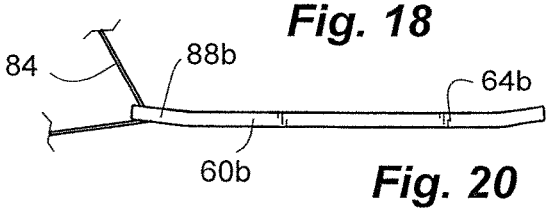
FIG. 20 is a side view of the strap with the plate of the mount of the system of FIG. 15.
Figure 21:
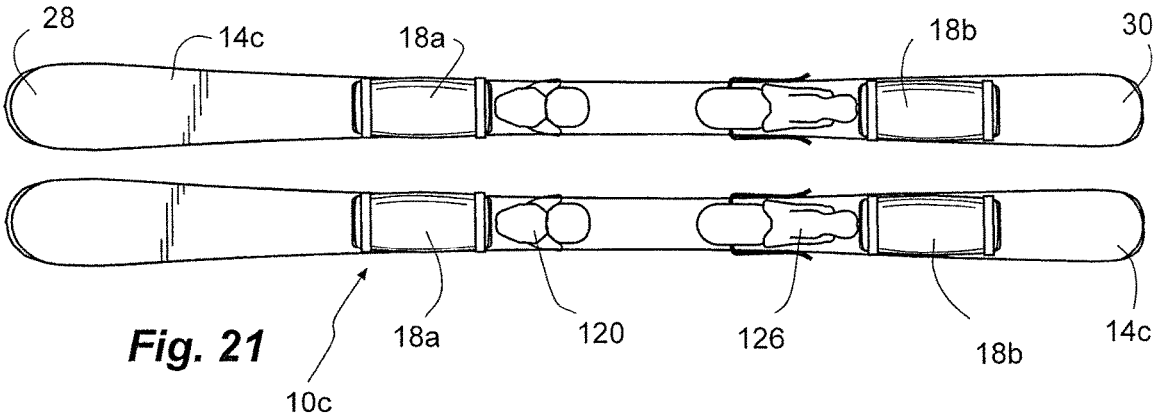
FIG. 21 is a top schematic view of another downhill snow ski sound system in accordance with an embodiment of the invention showing four wireless speakers carried by a pair of skis.
Figure 22:
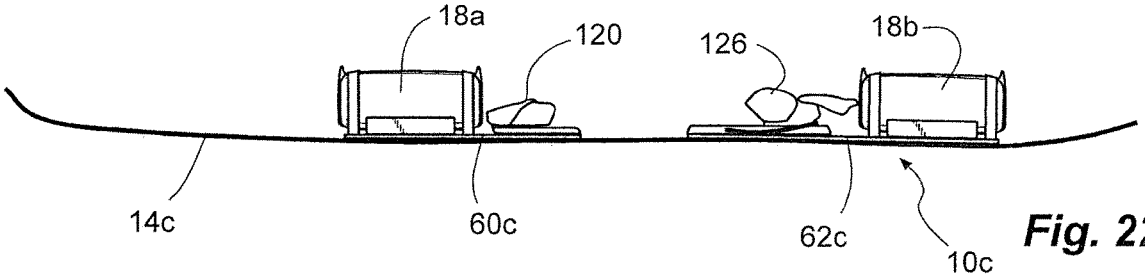
FIG. 22 is a side schematic view of the system of FIG. 21.
Figure 23:
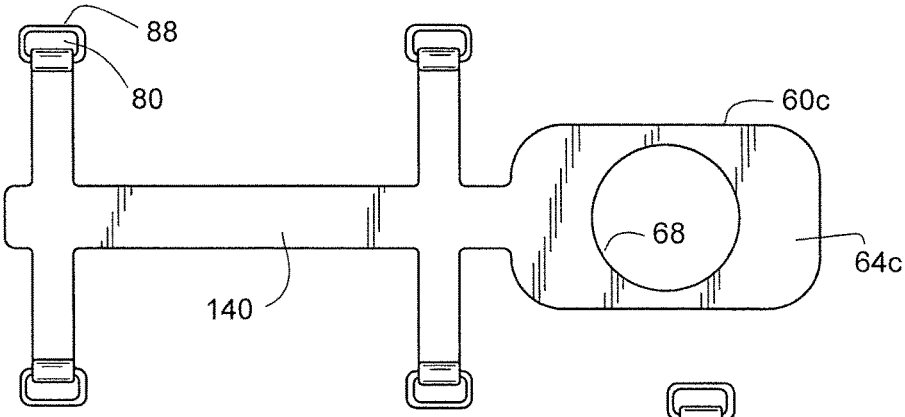
FIG. 23 is a top view of a plate of the mount of the system of FIG. 21 in accordance with an embodiment of the invention shown configured for a front of the ski and a front binding thereof.
Figure 24:
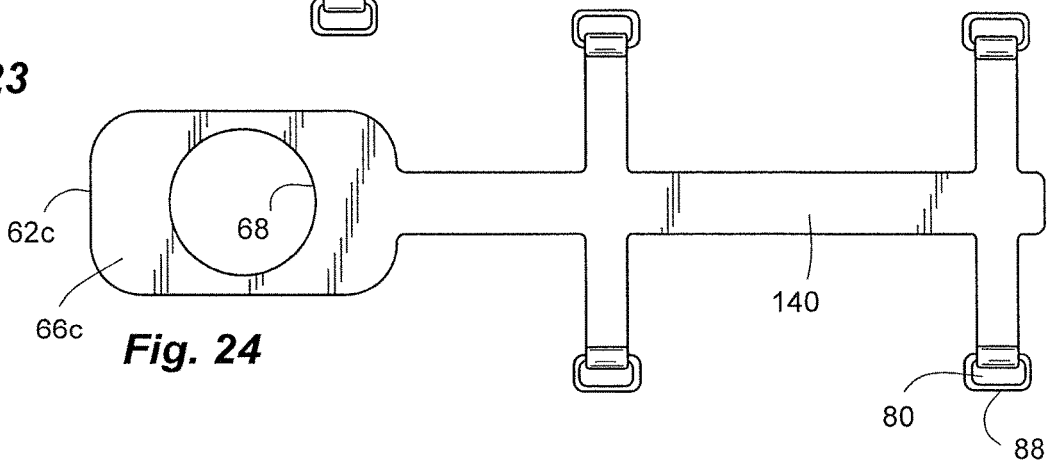
FIG. 24 is a top view of another plate of the mount of the system of FIG. 21 in accordance with an embodiment of the invention shown configured for a rear of the ski and a rear binding thereof.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

A mobile downhill snow ski sound system is presented to provide sound, such as music, while participating in downhill snow sports, such as snowboarding and skiing. In one aspect, the downhill snow sport can be non-powered and can rely on gravity and low-friction ski-boards to slide down a snow-covered slope. The term "ski-board" used herein to refer to a snow ski or snowboard. In another aspect, a skier can stand on and be releasably attached to the ski-board through bindings fixed to the ski-board. The sound system can be carried by the ski-board and/or the bindings thereof. Thus, the sound system can position speakers that are carried with the skier and the ski-board, but remote from the skier's ear so that the skier can participate in conversation with a companion. In another aspect, multiple speakers can be carried by the ski-board and separated and spaced-apart from one another to provide fuller, multi-directional sound. For example, speakers can be positioned on opposite sides of the ski or binding to provide sound on both sides of the skier, and/or both front and rear of the skier. In another aspect, the speakers can be positioned adjacent to the bindings to help with balance and to resist altering the performance characteristics of the ski-board.

In one aspect, the sound system can comprise a mount with a plate that can be positioned between, and sandwiched between, the ski-board and the binding. Thus, the mount and the plate can be positioned close to the binding, and without altering the ski-board. In another aspect, the mount can comprise at least one strap to attach the speaker to the plate, and thus to the ski-board and/or the binding. The strap can be used to accommodate speakers of various different sizes and/or shapes.

In one aspect, the sound system and the speaker can comprise a portable wireless speaker. Thus, each portable wireless speaker can have an audio speaker, a rechargeable battery, and a receiver coupled to the audio speaker and the battery receive an audio signal from an audio source. The audio source can be an audio player, such as an MP3 player, or a cellular phone or smart phone. The audio source and each portable wireless speaker can be paired, such as by Bluetooth®.

Referring to FIGS. 1-14, a sound system 10 is shown for downhill snow skiing sports. The sound system 10 can be utilized with a snowboard 14. As described above, the snowboard 14 is an example of a ski-board. The sound system 10 can comprise at least one speaker 18 carried by the snowboard 14 and positioned adjacent the snowboard 14 and bindings 22 and 24. Thus, the speaker 18 can be positioned away from the skier's ears to allow for communication with a companion. In addition, the speaker 18 can be positioned to resist balance and performance characteristics of the snowboard 14.

The snowboard 14 can have a nose 28 at one end and a tail 30 at an opposite end. In addition, the snowboard 14 can have an upper surface 34 to receive a skier, and a lower surface 38 for sliding on a snow-covered surface. The snowboard 14 can be bowed with a convex upward curvature when unloaded. A pair of snowboard bindings 22 and 24 can be coupled to the upper surface 34 of the snowboard 14. The bindings 22 and 24 can be spaced-apart from one another. The bindings 22 and 24 can receive a pair of boots to secure the pair of boots, and thus the skier, to the snowboard 14. The binding 22 and 24 can include a forward binding 22 coupled to the snowboard 14 closer to the nose 28 and a rearward binding 24 coupled to the snowboard 14 closer to the tail 30. The bindings 22 and 24 can extend transverse to a longitudinal axis 42 of the snowboard 14. Each binding can comprise an ankle strap with an ankle buckle, and a capstrap with a toe buckle. Each binding 22 and 24 can also comprise a heelcup and a highback. In one aspect, the snowboard 14 can have a hole pattern to received fasteners 50 that secure the bindings 22 and 24 to the snowboard 14. In another aspect, the snowboard 14 can have a slot to receive fasteners. The fasteners 50 can attach a disc 54 or baseplate of the bindings 22 and 24 to the snowboard 14. The rest of the binding, 22 or 24 can adjustably pivot about the disc 54 or baseplate to fix an angle of the binding 22 or 24 with respect to the longitudinal axis 42 of the snowboard 14.

At least one speaker 18 can be coupled to the binding 22 and/or 24, and/or the snowboard 14. Positioning the speaker 18 at the binding 22 and/or 24, and/or snowboard 14, separates the speaker 18 from the skier's ear to facilitate communication between companions. In addition, positioning the at least one speaker 18 at the snowboard can lower a center of gravity. Furthermore, positioning the at least one speaker at the binding 22 and/or 24 can reduce torque on the snowboard 14.

In one aspect, a single speaker 18 can be used. The speaker 18 can be positioned adjacent the binding 22 or 24. In one aspect, the speaker 18 can be positioned with less than an inch between the speaker 18 and the binding 22 or 24. In another aspect, the speaker 28 can be positioned contiguous or contacting the binding 22 or 24. Positioning the speaker 18 adjacent the binding 22 or 24 positions the added weight of the speaker 18 closest to the skier to resist interfering with balance. In addition, positioning the speaker 18 adjacent the binding 22 or 24 can resist torque forces on the snowboard 14. Thus, the position of the speaker 18 can resist altering the performance characteristics of the snowboard 14. In another aspect, the speaker 18 can be positioned directly on and contacting the upper surface 34 of the snowboard 14. Positioning the speaker 18 on the snowboard 14 can keep the center of gravity lower.

In another aspect, a pair of speakers 18 can be used. The speakers 18 can be located outside the pair of bindings 22 and 24, defining outer speakers 18*a* and 18*b*. A forward outer speaker 18*a* can be located forward of the forward binding 22, and a rearward outer speaker 18*b* can be located rearward of the rearward binding 24. In addition, the speakers 18 can be located inside the pair of bindings 22 and 24, defining inner speakers 18*c* and 18*d*. A forward inner speaker 18*c* can be located rearward of the forward binding 22, and a rearward inner speaker 18*d* can be located forward of the rearward binding 24. Using a pair of speakers 18 and positioning the speakers 18 spaced-apart near the bindings 22 and 24 can provide sound to surround the skier and facilitate hearing as the skier's head and torso turn while snowboarding. In another aspect, four speakers 18*a-d* can be used, including the outer and inner speakers 18*a-d* so that speakers 18*a-d* are positioned on both sides of each binding 22 and 24. Utilizing four speakers 18*a-d* can insure continuous sound around the skier during maneuvering.

The speaker(s) 18 can be coupled to the snowboard 14 and/or the binding(s) 22 and 24 without altering the snowboard 14. For example, the speaker(s) 18 can be coupled without adding holes to the snowboard 14, and/or without fastening additional fasteners to the snowboard 14.

A mount 60 can be coupled between the binding 22 or 24 and the snowboard 14. In one aspect, a single mount 60 can be used. In another aspect, a pair of mounts 60 can be used and coupled between the pair of snowboard bindings 22 and 24 and the snowboard 14. For example, a forward mount 60 can be coupled between the forward binding 22 and the snowboard 14, and a rearward mount 60 can be coupled between the rearward binding 24 and the snowboard 14.

The mount(s) 60 can comprise a plate 64 sandwiched between the binding 22 or 24 and the snowboard 14. The mount(s) 60 and the plate(s) 64 can separate the binding(s) 22 and 24 and the snowboard 14. In one aspect, the plate 64 can be flat and thin. For example, the plate 64 can have a thickness less than ⅜ inch. The thin plate 64 can reduce interference with the snowboard 14 performance and/or the binding 22 and 24 performance. The plate 64 can have an aperture 68 therein receiving a fastener 50 therethrough between the binding 22 or 24 and the snowboard 14. Thus, the binding 22 or 24 can be coupled to the snowboard 14 without interference by the plate 64. In one aspect, the plate 64 can be plastic and can be formed by injection molding. The plastic can be fiber reinforced.

In one aspect, the plate 64 can have a width Wp substantially matching a width Wb of the binding 22 or 24, or the bottom thereof. In another aspect, the plate 64 can have a perimeter 72 that substantially matches a bottom perimeter 76 of the binding 22 or 24. Thus, the plate 64 can substantially fill a gap between the binding 22 or 24 and the snowboard 14 around the perimeter of the binding 22 or 24 to reduce torque loads on the fasteners 50. In addition, the size and shape of the plate 64 can position at least one orifice 80 at the perimeter of the binding 22 or 24. The orifice 80 can be associated with the plate 64 and can receive a strap 84 that can extend from the orifice 80. The strap 84 can wrap around the speaker 18 to attach the speaker 18 to the mount 60, and thus to the binding 22 or 24 and the snowboard 14.

A ring 88 can be attached to the plate 64 and positioned outside the perimeter 76 or lateral side of the binding 22 or 24, and the perimeter 72 of the plate 64. The orifice 80 can be defined by the ring 88, and the strap 84 can be coupled to and can extend from the ring 88. The ring 88 can also be positioned adjacent the perimeter 76 of the binding 22 or 24. In addition, the ring 88 can be positioned outside the perimeter 72 of the plate 64. Positioning the ring 88 and the orifice 80 at the binding 22 or 24 can help position the speaker 18 adjacent the binding 22 and 24 as described above.

In one aspect, the ring 88 can comprise a pair of spaced-apart rings 88 on one side of the plate 64. Similarly, the strap 84 can comprise a pair of spaced-apart straps 84, each associated with a respective ring 88. Thus, the pair of straps 84 can wrap around opposite ends of the speaker 18 for a more stable attachment. In one aspect, the ring(s) 88 can be metal and can be molded into the plate 64 during injection molding. In another aspect, the ring(s) 88 can be snap-fit into channels in the plate 64. For example, the plate 64 can have a pair of adjacent, oppositely-facing channels to receive the ring 88 which can be inserted between the channels and twisted into the channels.

In another aspect, the ring 88 can comprise the pair of spaced-apart rings 88 on one side of the plate 64, and another pair of spaced-apart rings 88 on an opposite side of the plate 64. Thus, the plate 64 can have four rings 88 with four orifices 80. Similarly, the strap 84 can comprise four straps 84, each extending from a respective ring 88. The pair of straps 84 can extend from the spaced-apart rings 88 and around opposite ends of the speaker 18, and another pair of straps 84 can extend from the another pair of spaced-apart rings 88 and around opposite ends of another speaker 18. Thus, two speakers 18 can be coupled with a speaker 18 on each side of the plate 64, and the binding 22 or 24.

The straps 84 can be coupled to and can extend from the mount(s) 60, the plate(s) 64, the orifice(s) 80 and the ring(s) 88. Each strap 84 can have opposite free ends with an intermediate portion at the ring 88. A hook-an-loop type fastener 100 can releasably couple the opposite free ends together to form a loop 104 extending around a respective speaker 18. In one aspect, the straps 84 can be formed of nylon and the hook-and-loop type fasteners 100 can be sewn to the opposite ends. In another aspect, the stapes 84 can be elastic and the loops 104 can be expanded to extend over the speaker 18, and resilient to draw the speaker 18 towards the mount 64. In another aspect, the straps 84 can be a polymer and the free ends can be coupled together with a buckle. In another aspect, the straps 84 can have rubber or rubber-like grip surface to engage the speaker 18 to resist slipping of the speaker 18 with respect to the straps 84.

In addition, the speaker(s) 18 can be releasably coupled to the snowboard 14 and/or the binding 22 or 24. Thus, the speaker(s) 18 can be removed for charging. In addition, the speaker(s) 18 can be selectively removed and installed, to accommodate ski conditions and/or anticipated maneuvers. For example, the speaker(s) 18 can be removed in anticipation of jumps.

The speakers 18 can be elongated and can have a length longer than a width and a depth. Thus, the speakers 18 can have opposite distal ends that can be engaged by the straps 84. In addition, the speakers 18 can be bulbous, with an intermediate portion that is wider and/or deeper than the opposite distal ends to resist the speaker 18 from slipping from the straps 84. Furthermore, the opposite distal ends can have protrusions or tabs to further resist the speaker 18 from slipping from the straps 84.

The speakers 18 can be wireless speakers with an antenna or receiver to receive audio signals from a media player, such as a cellular phone or smart phone. The wireless speakers can pair with the audio source, such as by Bluetooth®. In addition, the speakers can have their own power source, such as a rechargeable battery.

Referring to FIGS. 15-20, another mount **60*b* is shown that is similar in many respect to that described above, and which description is hereby incorporated herein by reference. The following descriptions also apply to those preceding and following. The mounts 60*b* can have the orifice(s) 80 formed therein and the ring(s) 88*b* can be integral with the remainder of the plate 64*b*. Again, the plates 64*b* can be formed by fiber reinforced plastic, and by injection molding, with the rings 88*b* and orifices 80 formed along with the plate 64*b*. In another aspect, the plates 64*b* can be formed of metal, and can be formed by stamping to shape the plate 64*b* and form the orifice 80 and ring 88*b*, and by bending to angle the ring 88*b* out of the plane of the plate 64*b*, and away from the snowboard 14**.

Referring to FIGS. 21-24 another sound system **10*c* for downhill snow skiing sports is shown that is similar in many respect to those described above, and which description is hereby incorporated herein by reference. The following description also applies to those proceeding and following. The sound system 10*c* can be utilized with a pair of skis 14*c*. The ski 14*c* is an example of a ski-board. Each of the pair of skis 14*c* can have a tip/nose 28 and a tail 30. Each of the pair of skis 14*c* can have bindings. Each binding can have a toe piece 120 or tow binding, and a heel piece 126 or heel binding. The bindings 120 and 126 can be directly mounted to the skis 14*cb*, or mounted to a riser plate that is mounted to the skis 14*c***.

As with the snowboard 14, the sound system **10*c* can include four speakers 18 with a pair of speakers 18 on both skies 14*c*. Each ski 14*c* can have a forward and outer speaker 18*a* forward of the binding 120, and a rearward and outer speaker 18*b* rearward of the binding 126. Each ski 14*c* can have a pair of mounts 60*c* and 62*c*, including a forward mount 60*c* and a rearward mount 62*c*. Each mount 60*c* and 62*c* can have a plate 64*c* and 66*c* positioned between the binding 120 or 126 and the ski 14*c*. Each mount 60*c* and 62*c* can also have projection 140 that extends forward of the toe piece 120 or rearward of the heel piece 126. The projection 140 of the plate 64*c* and 66*c* can have the orifice(s) 80 and the ring(s) 88. The projection 140 can position the orifice(s) 80 and the ring(s) 88** forward and rearward of the bindings 120 and 126 so that the speakers 18 can be positioned forward and rearward of the bindings 120 and 16, and aligned with the skis 14*c*.

Figure 25:
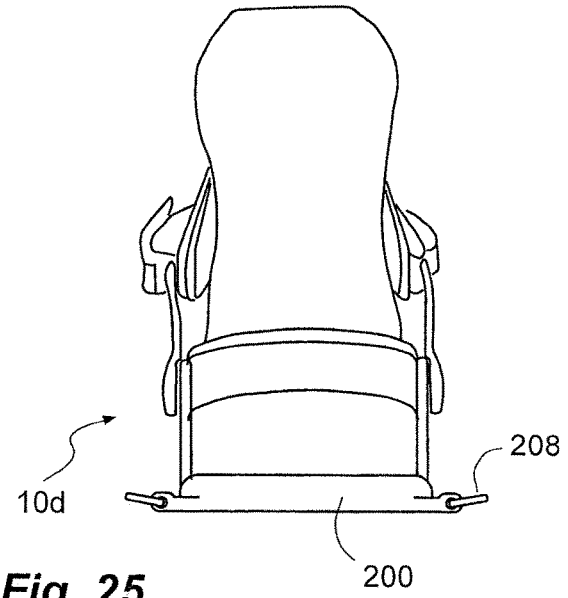
FIG. 25 is a rear view of a snowboard binding with a mount for another downhill snow ski sound system in accordance with an embodiment of the invention.
Figure 26:
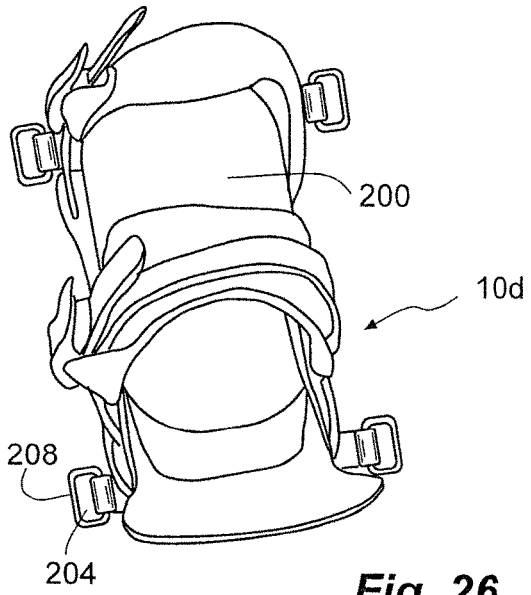
FIG. 26 is a top view of the snowboard binding with the mount of FIG. 25.
Figure 27:
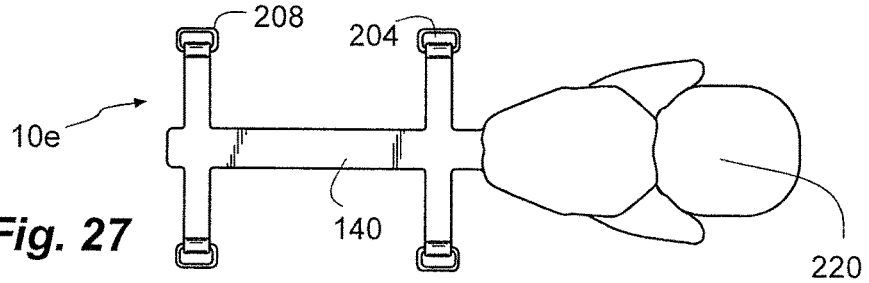
FIG. 27 is a top view of a ski binding with a mount for another downhill snow ski sound system in accordance with an embodiment of the invention.
Figure 28:
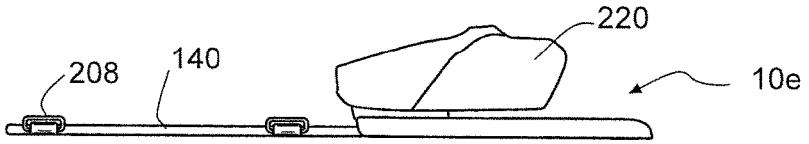
FIG. 28 is a side view of the ski binding with the mount of FIG. 27.
Figure 29:
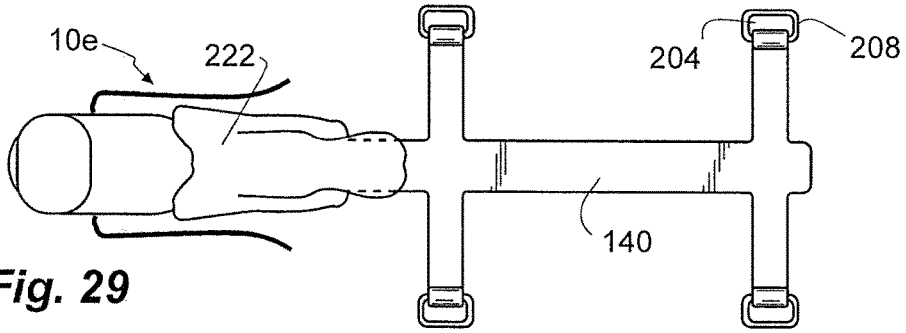
FIG. 29 is a top view of a ski binding with a mount for another downhill snow ski sound system in accordance with an embodiment of the invention.
Figure 30:
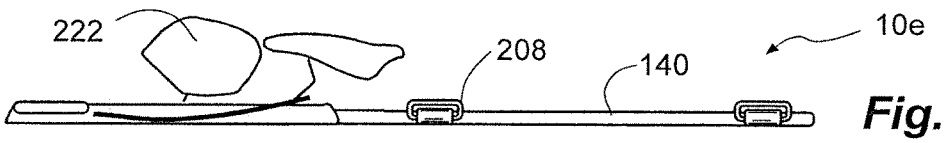
FIG. 30 is a side view of the ski binding with the mount of FIG. 29.

Referring to FIGS. 25 and 26, another sound system 10*d* for downhill snow skiing sports is shown that is similar in many respect to those described above, and which description is hereby incorporated herein by reference. The following description also applies to those proceeding and following. The snowboard bindings 200 themselves can be provided with the orifice(s) 204 and ring(s) 208 to receive the straps 84. The rings 208 can be coupled to and extend laterally from a base or a bottom of the snowboard binding 200. Thus, the orifice(s) 204 can be associated with and carried by the bindings 200 themselves.

Referring to FIGS. 27-30, another sound system 10*e* for downhill snow skiing sports is shown that is similar in many respect to those described above, and which description is hereby incorporated herein by reference. The following description also applies to those proceeding. The ski bindings 220 and 222 themselves can be provided with the orifice(s) 204 and ring(s) 208 to receive the straps 84. The rings 208 can be coupled to and extend longitudinally from a base or a bottom of the ski bindings 220 and 222. The plates The description, features, characteristics and advantages of one embodiment can be applied to the other embodiments.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

The terms "interference fit" and "friction fit" and "press-fit" are terms of art used interchangeably herein to refer to deliberately causing, increasing and/or using friction to deliberately resist movement. An interference fit or friction fit is different than and great than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction fit can be created by surface roughness that is rougher.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A downhill snow ski sound system comprising:

a) a ski-board having a nose and a tail;

b) a binding configured to receive a boot and to secure the boot to the ski-board;

c) an orifice located at a perimeter of the binding, the orifice being secured with respect to the binding and the ski-board;

d) a strap coupled to and extending from the orifice;

e) a speaker releasably coupled to the ski-board and the binding by the strap; and f) the speaker positioned adjacent the binding with less than an inch between the speaker and the binding.

2. The system in accordance with claim 1, wherein:

the speaker positioned directly on and contacting the ski-board.

3. The system in accordance with claim 1, further comprising a mount coupled between the binding and the ski-board, wherein the mount further comprises:

a plate sandwiched between the binding and the ski-board; and an aperture in the plate receiving a fastener therethrough between the binding and the ski-board; and the orifice associated with the plate.

4. The system in accordance with claim 3, wherein the mount further comprises:

a ring attached to the plate and positioned outside the binding; and the orifice defined by the ring and the strap coupled to and extending from the ring.

5. The system in accordance with claim 4, wherein:

the ring comprises a pair of spaced-apart rings on one side of the plate; and the strap comprises a pair of spaced-apart straps each associated with a respective ring and wrapping around opposite ends of the speaker.

6. The system in accordance with claim 3, wherein:

the plate is flat and thin with a thickness less than ⅜ inch.

7. The system in accordance with claim 3, wherein:

the plate has a perimeter configured to substantially match a perimeter of the binding; and the orifice is configured to be positioned outside the perimeter of the binding.

8. The system in accordance with claim 3, wherein:

the speaker is positioned on the mount.

9. The system in accordance with claim 1, further comprising:

the ski-board comprises a snowboard;

the binding comprises a pair of bindings;

a pair of mounts, each coupled between a respective binding and the snowboard;

each mount comprising a plate sandwiched between the respective binding and the snowboard;

the orifice comprising an orifice associated with each plate;

the speaker comprising at least a pair of speakers associated with the pair of bindings; and each speaker and each orifice positioned on a lateral side of a respective binding.

10. The system in accordance with claim 1, further comprising:

the ski-board comprises a pair of skis;

the binding comprises a pair of bindings on each of the pair of skis;

a pair of mounts, each coupled between a respective binding and a respective ski;

each mount comprising a plate sandwiched between the respective binding and the respective ski;

the orifice comprising an orifice associated with each plate;

the speaker comprising at least a pair of speakers; and each speaker and each orifice positioned forward or rearward of a respective binding.

11. The system in accordance with claim 1, further comprising:

the orifice being associated with and carried by the binding.

12. The system in accordance with claim 1, wherein:

the orifice comprises a pair of orifices; and the strap extends between the pair of orifices and engages the speaker.

13. A mount configured for a downhill snow ski sound system with a speaker and a ski-board with a binding, the mount comprising:

a) a plate sized and shaped to be sandwiched between the binding and the ski-board;

b) an aperture in the plate configured to receive a fastener therethrough between the binding and the ski-board;

c) an orifice associated with the plate and positioned to be outside a perimeter of the binding; and d) a strap coupled to and extending from the orifice and configured to couple to the speaker to couple the speaker to the ski-board and the binding proximate the binding.

14. The mount in accordance with claim 13, wherein:

the plate is flat and thin with a thickness less than ⅜ inch.

15. The mount in accordance with claim 13, wherein:

the plate has a perimeter configured to substantially match a perimeter of the binding; and the orifice is configured to be positioned outside the perimeter of the binding.

16. The mount in accordance with claim 13, wherein:

the orifice further comprises a pair of spaced-apart rings on one side of the plate; and the strap comprises a pair of spaced-apart straps each associated with a respective ring and configured to wrap around opposite ends of the speaker.

17. The mount in accordance with claim 13, further comprising:

a speaker releasably coupled to the plate by the strap.

18. The system in accordance with claim 17, wherein:

the speaker is positioned on the mount.

19. The system in accordance with claim 13, wherein:

the orifice comprises a pair of orifices; and the strap extends between the pair of orifices.

20. A downhill snow ski sound system comprising:

a) a snowboard having a nose and a tail;

b) a pair of snowboard bindings configured to receive a pair of boots and to secure the pair of boots to the snowboard, and comprising a forward binding coupled to the snowboard closer to the nose and a rearward binding coupled to the snowboard closer to the tail;

c) a pair of mounts coupled between the pair of snowboard bindings and the snowboard, and comprising a forward mount coupled between the forward binding and the snowboard and a rearward mount coupled between the rearward binding and the snowboard;

d) four speakers releasably coupled to the pair of snowboard bindings and the snowboard by the pair of mounts, and comprising a pair of outer speakers and a pair of inner speakers, the pair of outer speakers being located outside the pair of snowboard bindings and comprising a forward outer speaker located forward of the forward binding and a rearward outer speaker located rearward of the rearward binding, the pair of inner speakers being located inside the pair of snowboard bindings and comprising a forward inner speaker located rearward of the forward binding and a rearward inner speaker located forward of the rearward binding;

e) each of the pair of mounts further comprise:

i) a plate sandwiched between a respective binding and the snowboard;

ii) an aperture in the plate receiving fasteners therethrough between the respective binding and the snowboard;

iii) an orifice associated with the plate and positioned outside the respective binding; and iv) a strap coupled to and extending from the orifice; and f) each speaker positioned adjacent the binding with less than an inch between a respective speaker and binding.

* * * * *